United States Patent [19]

Rainwater

[11] 4,066,089

[45] Jan. 3, 1978

[54] COLLAPSIBLE SHELTER STRUCTURE

[76] Inventor: Orman M. Rainwater, 947½ N. Wilcox Ave., Hollywood, Calif. 90038

[21] Appl. No.: 686,887

[22] Filed: May 17, 1976

[51] Int. Cl.[2] ..... A45F 1/16

[52] U.S. Cl. ..... 135/3 E; 135/4 R; 135/DIG. 9

[58] Field of Search ..... 135/3 E, 4 R, 4 A, DIG. 9

[56] References Cited

U.S. PATENT DOCUMENTS

| | | | |
|---|---|---|---|
| 1,291,758 | 1/1919 | Buck | 135/4 R |
| 1,449,894 | 3/1923 | Dial | 135/2 |
| 1,502,898 | 7/1924 | Berg | 135/4 R |
| 1,735,737 | 11/1929 | Dial | 135/4 R |
| 2,705,966 | 4/1955 | Magary | 135/1 R |
| 2,987,069 | 6/1961 | Presnick | 135/4 R |
| 3,212,512 | 10/1965 | Morris | 135/3 E |

FOREIGN PATENT DOCUMENTS

| | | | |
|---|---|---|---|
| 1,461,516 | 11/1966 | France | 135/4 R |
| 2,162,124 | 12/1971 | Germany | 135/4 R |
| 2,425,857 | 12/1975 | Germany | 135/4 R |

*Primary Examiner*—Werner H. Schroeder
*Attorney, Agent, or Firm*—Flam & Flam

[57] ABSTRACT

The collapsible shelter structure comprises a pair of composite frame sections corresponding, generally, to front and back walls of the shelter. The front and back frame sections are held in spaced relationship by struts that themselves may be foldable as by a retractable splint structure. The struts are external of the fabric or other flexible walls forming the shelter and all of the frame elements remain connected to the companion elements when the structure is collapsed. In a tent configuration, the front and rear frame sections each include rafters that pivotally connect together to form a weather stable arrangement even absent a ridge pole.

4 Claims, 16 Drawing Figures

FIG. 12.
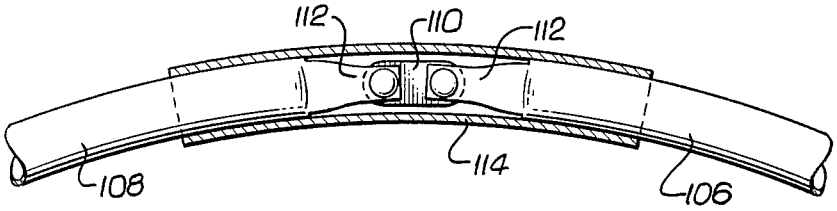
FIG. 13.
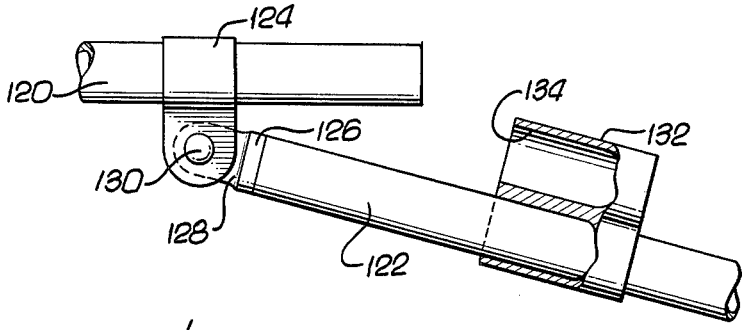
FIG. 15.
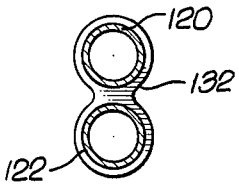
FIG. 14.
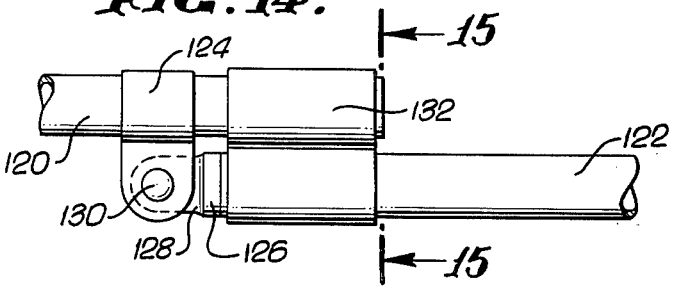
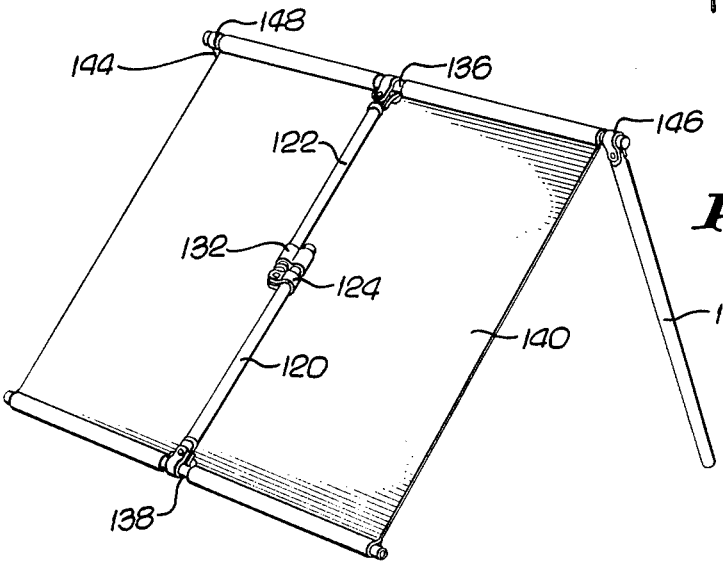
FIG. 16.

COLLAPSIBLE SHELTER STRUCTURE

FIELD OF INVENTION

This invention relates to a portable shelter structure such as of the type shown and described in my prior U.S. Pat. No. 3,469,588 issed Sept. 30, 1969 entitled ARTICULATED MULTI-SECTION SHELTER OR FRAME STRUCTURE. More particularly, this invention relates to a camper's tent and a foldable frame structure therefor.

BACKGROUND OF THE INVENTION

The usual camper's tent is an enigma comprising a series of disconnected tubes and canvas parts. Ordinarily, it isn't sufficient to understand how the parts go together to comprise the tent; it is also essential to know the specific sequence in which the parts go together. Given a little wind and weather, the chances of a prompt assembly are low.

In my said prior U.S. Pat. No. 3,469,588, there is shown a collapsible frame structure. Primarily the object of this invention is to provide an improved collapsible tent structure in which all of the parts remain at least partially connected when the tent is collapsed so that the task of erecting the tent is vastly simplified.

Another object of this invention is to provide a collapsible shelter or tent that can easily be erected by one person and that has vastly improved characteristics of stability. Staking is required only in extreme weather conditions. Still another object of this invention is to provide an improved connected structure especially suitable for use in a collapsible tent or shelter organization.

SUMMARY OF THE INVENTION

In order to accomplish the foregoing objects, I provide a collapsible tent structure in which the operative frame parts are arrayed as elements of a truncated four-sided pyramid. Front and rear frame sections are held in spaced apart relationship by folding struts. By a unique arrangement of rafters articulated relative to the pyramid elements, it is possible readily to open and close the tent. By virtue of the relative orientation of frame components, the tent structure is without a ridge pole; yet exceptional stability is achieved.

BRIEF DESCRIPTION OF DRAWINGS

A detailed description of the invention will be made with reference to the accompnaying drawings wherein like numerals designate corresponding parts in the several figures. These drawings are to scale.

FIG. 12 is a sectional view taken along the plane corresponding to line 12—12 of FIG. 11.

FIG. 13 is an elevational view showing a pair of pivotally connected frame sections and an alternate slidable splint tube for holding the sections in rigid relationship.

FIG. 14 is a view similar to FIG. 13 but showing the sections held together by the slidable splint.

FIG. 15 is a sectional view taken along the plane corresponding to line 15—15 of FIG. 14.

FIG. 16 is a pictorial view of a simple shelter structure ulilizing the splint mechanism of FIGS. 13 and 14.

DETAILED DESCRIPTION OF PREFERRED EMBODIMENT

The following detailed description is of the best presently contemplated modes of carrying out the invention. This description is not to be taken in a limiting sense, but is made merely for purposes of illustrating the general principles of invention since the scope of the invention is best defined by the appended claims.

Structural and operational characteristics attributed to forms of the invention first described shall also be attributed to forms later described, unless such characteristics are obviously inapplicable or unless specific exception is made.

Figure 1:
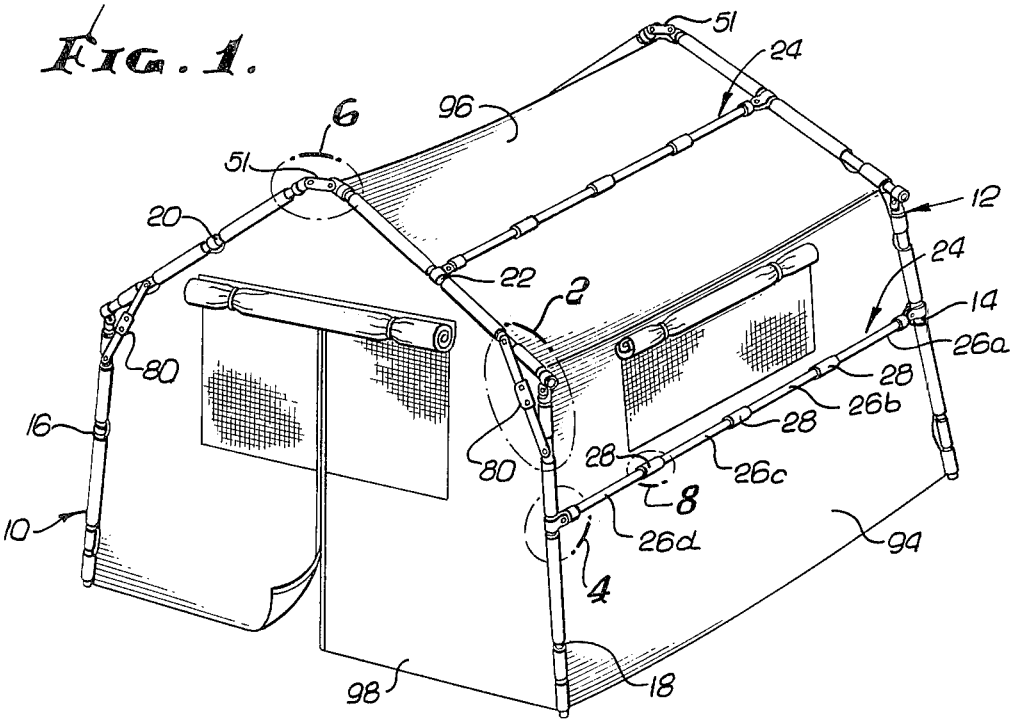
FIG. 1 is a pictorial view of an assembled tent incorporating the present invention.

The tent shown in FIG. 1 comprises an external frame with the flexible fabric draped along the frame interior. The frame comprises a generally vertical front section 10 and a generally vertical rear section 12 held apart by a series of horizontally extending spacers 24. The front and rear sections 10 and 12 are indentical, and generally of multi-element inverted U-shaped form. The front section, for example, comprises four serially joined frame elements, a pair of standards 16 and 18 and a pair of rafters 20 and 22. The standards 16 and 18 and the rafters 20 and 22 are pivotally connected. Thus the upper end of the standard 16 is pivotally connected to the lower end of the rafter 20 and the top of the rafter 20 is pivotally connected at the ridge point to the companion rafter 22 which in turn is pivotally connected at its lower end to the top of the opposite standard 18.

Figure 10:
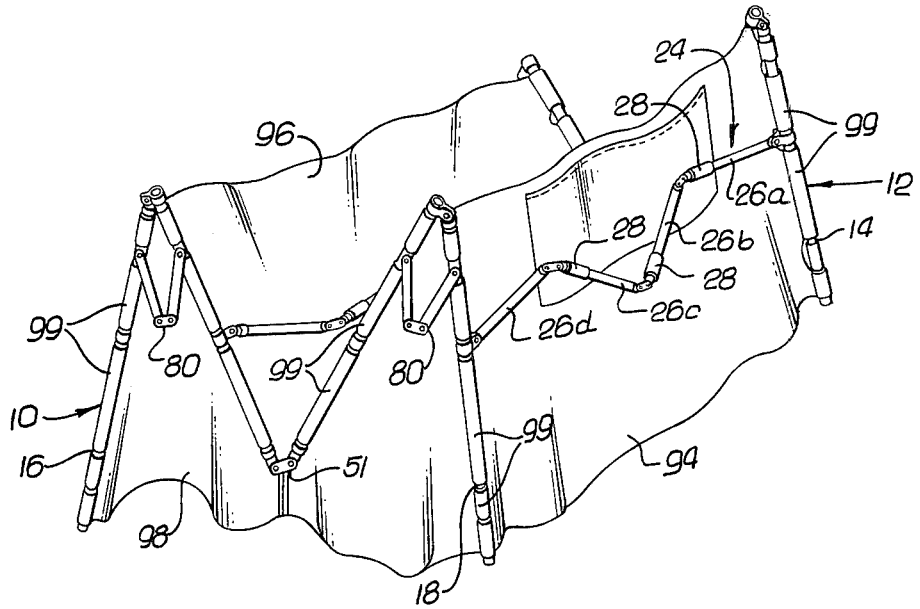
FIG. 10 illustrates the shelter frame partially extended or partially folded.

One of the horizontal spacers 24 for holding corresponding frame elements of the front and rear sections is shown in FIG. 10

The spacer 24 comprises a series of jointed spacer elements **26*a*, 26*b*, 26*c* and 26*d*. One of the spacer elements 26*a* is pivotally connected to the center of the rear standard 14 so that it can be folded alongside. The other elements are successively jointed with the opposite end section 26*d* pivotally connected to the center of the front standard 18**.

The spacer elements 26 are made into a rigid brace by the aid of three splint tubes 28 slidably accommodated on the first three elements **26*a*, 26*b* and 26*c*. The manner in which the spacer sections are connected to each other and to the standards 14 and 18 is best shown in FIGS. 4, 5, 8 and 9**.

Figure 4:
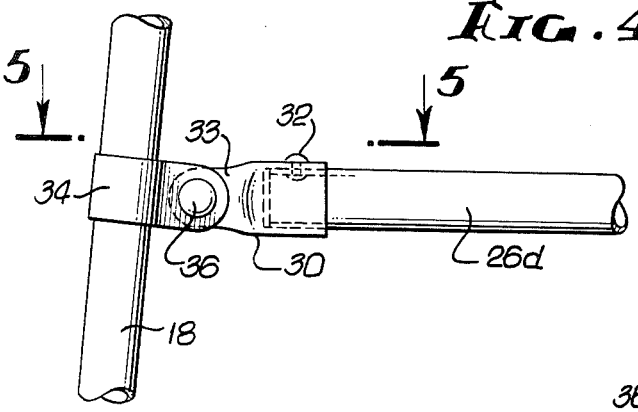
FIG. 4 is an enlarged fragmentary view showing the manner in which one end of a spacer is socketed.
Figure 5:
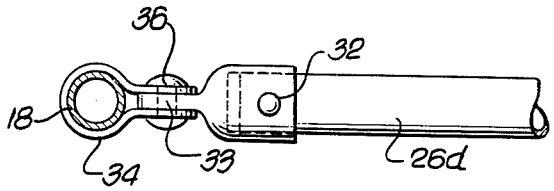
FIG. 5 is a sectional view taken along the plane corresponding to line 5—5 of FIG. 4.

As shown in FIG. 4, the end spacer element 26*d* (like the opposite end section 26*a*) carries a cup 30 attached to the section 26*d* as by a rivet 32. The cup has a pivot plate 33 that is fastened between ears of a clamp 34 (FIG. 5) that encircles the standard 18. A rivet 36 extends through the ears and the pivot plate 32.

Figure 8:
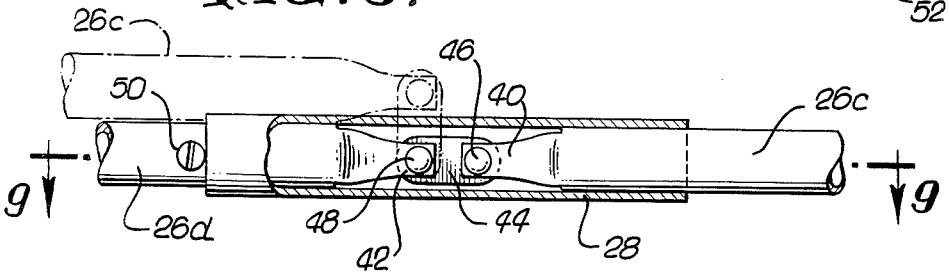
FIG. 8 is an elevational view of a splint tube and companion sections of a spacer, a portion of the apparatus being broken away and shown in section.
Figure 9:
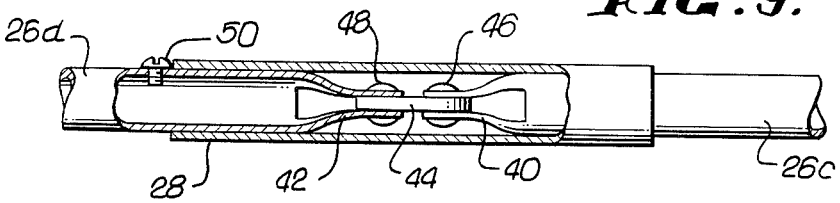
FIG. 9 is a sectional view taken along a plane corresponding to line 9—9 of FIG. 8.

The spacer elements are pivotally connected together in a manner best shown in FIGS. 8 and 9. The ends of adjoining spacer elements 26*d* and 26*c*, for example, are each formed to provide spaced ears as at 40 and 42 between which opposite ends of a pivot bar 44 are received. Rivets 46 and 48 pivotally connect the ends of the spacer elements and the pivot bar 44. The center-to-center distance of the rivets corresponds to the diameter of the tubular spacer elements 26*c* and 26*d*. Accordingly, the elements 26*c* and 26*d* can be folded one along the other as indicated in phantom lines in FIG. 8 without detaching the connection. By such means the mechanism may be collapsed when the splint tube 28 is withdrawn. However, when the splint tube 28 is positioned over the contiguous ends of both spacer elements 26*c* and 26*d*, the elements act as a unitary brace. A stop 50 in the form of a screw or rivet limits the movement of the splint tube and properly positions it centrally of the ends of the spacer elements. In a like manner, spacers are provided for corresponding rafters of the front and rear sections.

Figure 6:
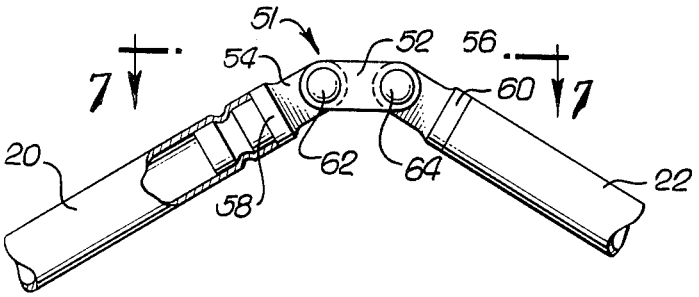
FIG. 6 is a fragmentary elevational view showing the ridge pivot connector cooperable with companion rafters, a portion of one of the rafters being broken away and shown in section.
Figure 7:
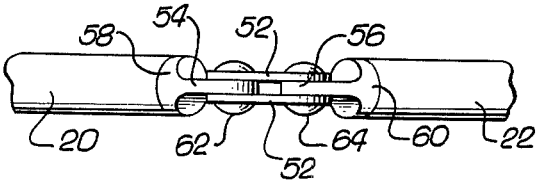
FIG. 7 is a fragmentary top plan view of the ridge pivot connector taken in a direction indicated by line 7—7 of FIG. 6.

Rafters 20 and 22 of the front section are pivotally connected together by a ridge connector 51 comprising a pair of pivot bars 52 and (FIGS. 6 and 7). These bars are connected at opposite ends respectively to pivot plates 54 and 56 of fittings 58 and 60 secured to the ends of the rafters 20 and 22. Rivets 62 and 64 secure the pivot bars to the pivot plates and have a center-to-center distance equal to the diameter of the rafters 22 such that they too may be folded back one along the other.

Figure 2:
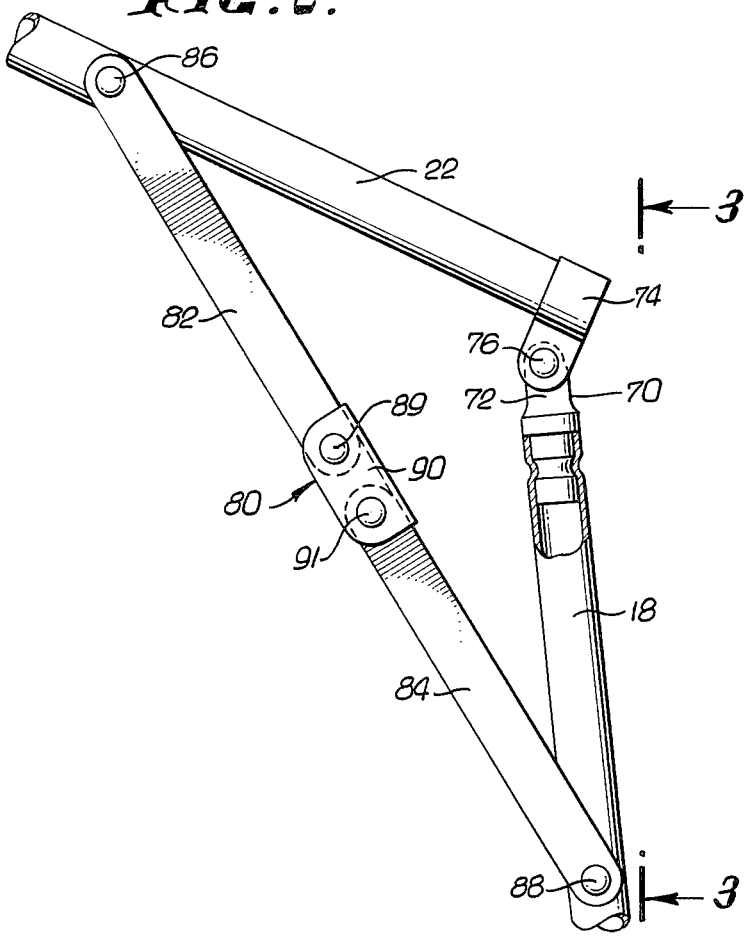
FIG. 2 is an enlarged fragmentary elevational view showing a typical corner brace as indicated by the circled part 2 of FIG. 1, a portion of the apparatus being broken away and shown in section.
Figure 3:
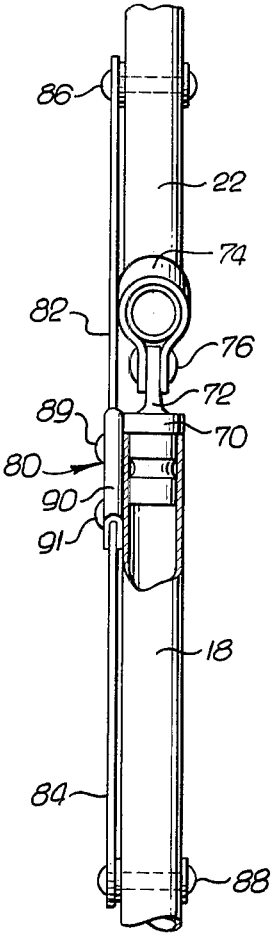
FIG. 3 is an elevational view taken along the plane indicated by line 3—3 of FIG. 2.

The standards 16 and 18 are pivotally connected to the rafters 20 and 22 respectively in a manner shown in FIGS. 2 and 3. Thus the fitting 70, similar to the fitting 58, is secured to the upper end of the standard 18 to provide a pivot plate 72 cooperable with ears of a clamp 74 encircling the end of the rafter. A rivet 76 secures the parts together. The rivet 76 is offset sufficiently from the axis of the rafter 22 to allow the standard and rafter to be folded in side-by-side relationship as indicated in FIG. 10. A toggle brace 80 between the standard 18 and rafter 22 comprises a pair of links 82 and 84 respectively pivoted to the front section elements by rivets 86 and 88. The links 82 and 84 are aligned and held against over center movement by a channel 90. The channel 90 receives the link ends and pivotally connect to each of them. Rivets 89 and 91 secure the links.

FIG. 10 illustrates the tent in an intermediate stage of extension. In the position shown, the front and rear frame sections are folded and the toggle brace 80 is broken. The standards and rafters form a series of links folded one to the next with the ridge connector 51 positioned downwardly adjacent the lower ends of the standards 16 and 18. With all spacers broken like spacer 24, the folded front section of the frame and the folded rear section of the frame can be moved towards each other to complete a compact bundle.

In order to extend the tent from the intermediate folded position illustrated in FIG. 10, all braces 24 are first extended by properly positioning the splint tubes 28. The tent can then be raised by moving the ridge connector 51 upwardly. This can be done by one person. To do this, one stands beside the spacer 24 between the standards 14 and 18 facing the roof region, reaching into the trough. The spacer between the rafters of the front and rear frame sections is then grasped with hands spread well apart. With a motion corresponding generally to a weight lifter's arm curl, the spacer is raised. The rafters move into proper position. With the tent assuming its near erect configuration, the toggle braces 80 are snapped into position. Two persons can readily erect and fold the tent, one person manipulating the elements of the front frame section and another manipulating the elements of the rear frame section.

In the form shown, the braces 24 are made up of an even number of elements. This allows the elements to fold neatly in side-by-side relationship. With an odd number of elements, one brace element may detach from the companion brace element or front or rear frame section element, as by a socket arrangement. Optionally all braces may remain pivotally in which case the folded front and rear sections will be offset from each other when the mechanism is collapsed.

The four standards 14, 16 etc. are purposely not vertical. Instead they tilt inwardly toward the center of the tent to form elements of a truncated pyramid. This requires the fabric side panels 94, roof panels 96 as well as the front and rear panels 98 to be cut substantially as trapezoids. By virtue of the sloping configuration of the tent walls, the tent is exceedingly stable and capable of resisting moderate wind. The lower edges of the panels preferably have loops (not shown) for stakes that may be required to secure the tent in heavy wind and weather. The panels are secured to the inside of the frame by a series of fabric tubes 99 sewn about the standards and rafters.

Figure 11:
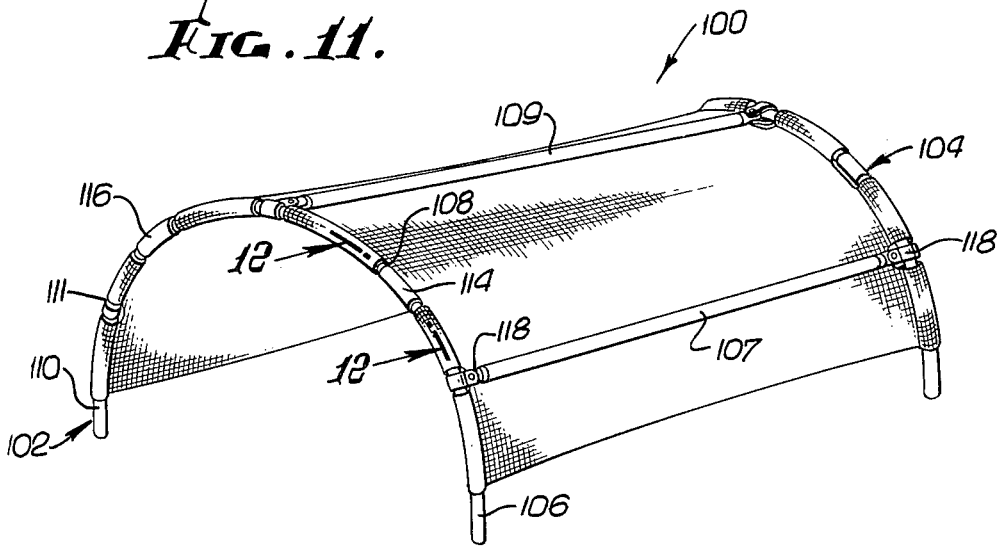
FIG. 11 is a pictorial view of a shelter structure incorporating a splint tube of the type shown in FIGS. 8 and 9 in which the splint tube and frame sections are curved.

In the form shown in FIGS. 11 and 12 an elementary shelter 100 is provided that includes a front frame section 102 and a rear frame section 104 held apart by a series of spacers 107, 109 and 111. The front frame section is in the form of a curved inverted U. A single generally semi-cylindrical fabric panel inside the spacers 106 provides the shelter.

The front and rear frame sections are identical. The front section comprises three elements 106, 108 and 110 pivotally connected together in a manner shown in FIG. 12. Thus adjacent sections 106 and 108 are illustrated that have ends flattened to provide ears 112 pivotally connected to a pivot bar 110. The three frame elements are splinted by tubes 114 and 116 both curved to conform to the configuration of the frame elements. The double pivot connection between adjacent frame elements allows them to be folded in side-by-side relationship.

The spacers 106 may be made in parts as in the previous form. Optionally in the present instance the spacer bars 106 are of one piece construction having ends acting as sockets detachably to receive the ends of projections 118 pivotally mounted at corresponding positions on the front and rear frame sections. The spacers 106 in the present instance are installed by a toggle like action described more fully in my said prior U.S. Pat. No. 3,469,588. In the present instance the frame sections may be folded together and arranged in a compact package.

Multipart spacers may be made rigid by a different form of splint. Thus as shown in FIG. 13, a pair of spacer elements 120 and 122 are pivotally connected together by an offset clamp 124. The clamp encircles the companion spacer sections 120 near, but spaced from its end. The end of the companion spacer section 122 carries a fitting 126 having a pivot plate 128 attached to the ears of clamp 124 by rivet at 130. The rivet 130 is offset sufficiently such that the brace section 120 can be moved in a counterclockwise direction (FIG. 13) to lie alongside the spacer section 122. However, by moving the element 120 in a clockwise direction, the elements form essentially straight line extensions one of the other. In order to lock the sections in such extended position, a splint 132 is provided. The splint is slidably mounted on the element 122 and provides an offset socket 134 to receive the end of the companion element 120 beyond the clamp 124 and as illustrated in FIG. 14.

The splint can be used in the tent structure of FIG. 1 as well as the shelter structure of FIG. 11. One simple use is shown in FIG. 16. Elements 120 and 122 are used between parallel frame elements 136 and 138 to stretch fabric 140 into a generally flat panel. Pivoted legs 142 and 144 convert the panel into a lean-to.

The proximal ends of the legs 142 and 144 are riveted to ears of clamps 146 and 148. The rivets provide offset axes of movement of the legs so that they may be folded alongside the frame element 124.

In order to collapse the unit, the splint 132 is retracted and frame elements 120, 122, 124 and 126 and moved into a tight bundle. The legs 142 and 144 are then folded inwardly. As in the previous forms, the elements of the shelter structure all remain in together when collapsed. No guesswork is involved.

Intending to claim all novel, useful and unobvious features shown or described, I make the following CLAIMS:

1. In a collapsible shelter structure:

a. a front frame section;

b. a rear frame section;

c. each of said sections comprising a series of four frame elements pivotally and non-detachably connected together to be folded one along the other and to be extended into frame configuration with the end elements forming standards at the corners of the shelter structure and the intermediate elements forming rafters;

d. a series of substantially horizontal braces, one for each of two corresponding frame elements of the front and rear frame sections respectively, each brace being connected at opposite ends respectively substantially centrally of the respective frame elements;

e. said rafters of each frame section being pivotally connected together at a floating ridge point free of a ridge pole;

f. means supporting said floating ridge points in elevated position, comprising braces between the rafters and the corresponding standards; and g. flexible panel means attached to the frame sections inside the braces whereby the braces are accessible for manipulation for movement of the shelter from an intermediate collapsed position with the ridge points lowered to an extended position with the ridge points raised.

2. The combination as set forth in claim 1 in which said braces between said rafters and said standards are toggle braces that automatically lock upon movement of said frame elements into operative position.

3. The combination as set forth in claim 1 in which said standards are each inclined upwardly toward the center of the shelter whereby said shelter is stabilized against moderate wind and weather.

4. The combination as set forth in claim 1 in which said horizontal braces each comprise an even number of elements pivotally and non-detachably connected in series with the end elements pivotally and non-detachably connected respectively to corresponding elements of said frame sections; and splint means releasably holding the elements of said braces in rigid extended relationship whereby said braces may be made operative prior to movement of said partially collapsed shelter to its elevated position and whereby said brace elements may be folded one upon the other.

* * * * *